US009852571B2

(12) United States Patent
Hodatsu

(10) Patent No.: US 9,852,571 B2
(45) Date of Patent: Dec. 26, 2017

(54) PAPER SHEET PROCESSING DEVICE

(71) Applicant: GLORY LTD., Hyogo (JP)

(72) Inventor: Tsuyoshi Hodatsu, Tokyo (JP)

(73) Assignee: GLORY, LTD., Hyogo (JP)

( * ) Notice: Subject to any disclaimer, the term of this patent is extended or adjusted under 35 U.S.C. 154(b) by 0 days.

(21) Appl. No.: 15/122,347

(22) PCT Filed: Feb. 27, 2015

(86) PCT No.: PCT/JP2015/055808
§ 371 (c)(1),
(2) Date: Aug. 29, 2016

(87) PCT Pub. No.: WO2015/133392
PCT Pub. Date: Sep. 11, 2015

(65) Prior Publication Data

US 2016/0371912 A1 Dec. 22, 2016

(30) Foreign Application Priority Data

Mar. 4, 2014 (JP) ..... 2014-041631

(51) Int. Cl.
*B65H 29/40* (2006.01)
*G07D 11/00* (2006.01)
(Continued)

(52) U.S. Cl.
CPC ..... *G07D 11/0021* (2013.01); *B65H 29/40* (2013.01); *B65H 29/62* (2013.01);
(Continued)

(58) Field of Classification Search
CPC ..... G07D 11/0021; B65H 29/40; B65H 2701/1912
See application file for complete search history.

(56) References Cited

U.S. PATENT DOCUMENTS 9,586,784 B2 * 3/2017 Hodatsu ..... G07D 11/00
2004/0135303 A1 * 7/2004 Weiler ..... B41F 13/54 270/5.02
(Continued)

FOREIGN PATENT DOCUMENTS

EP 2991047 A1 3/2016
JP 4896997 B2 3/2012
(Continued)

OTHER PUBLICATIONS

International Search Report from International Application No. PCT/JP2015/055808 dated Apr. 7, 2015.
(Continued)

*Primary Examiner* — Jeremy R Severson
(74) *Attorney, Agent, or Firm* — Brundidge & Stanger, P.C.

(57) ABSTRACT

This paper sheet processing device is provided with a casing (10), an intake unit (20), an identification unit (60), a second transportation unit (50) for transporting sheets of paper substantially horizontally, a plurality of collection units (80, 90) for collecting the sheets of paper transported by the second transportation unit (50), and vaned rollers (81, 91) provided correspondingly with respect to the collection units (80, 90). With regards to any two of the collection units (80, 90) that are adjacent to one another, the direction of rotation of the vaned roller (81) corresponding to one of the collection units (80, 90) and the direction of rotation of the vaned roller (91) corresponding to the other collection unit (80, 90) are opposite each other.

11 Claims, 7 Drawing Sheets

(51) Int. Cl.
*B65H 29/62* (2006.01)
*B65H 31/06* (2006.01)

(52) U.S. Cl.
CPC ..... *B65H 31/06* (2013.01); *G07D 11/0003* (2013.01); *G07D 11/0063* (2013.01); *G07D 11/0081* (2013.01); *B65H 2301/42146* (2013.01); *B65H 2701/1912* (2013.01)

(56) References Cited

U.S. PATENT DOCUMENTS

| | | | | |
|---|---|---|---|---|
| 2010/0007075 | A1 | 1/2010 | Ito et al. | |
| 2010/0117294 | A1* | 5/2010 | Maekawa ..... | B65H 1/24 271/265.01 |
| 2010/0244356 | A1 | 9/2010 | Sato et al. | |
| 2014/0130450 | A1* | 5/2014 | Uehara ..... | G07D 11/0081 53/128.1 |

FOREIGN PATENT DOCUMENTS

| | | | |
|---|---|---|---|
| WO | 2009/028071 | A1 | 3/2009 |
| WO | 2010/095213 | A1 | 8/2010 |

OTHER PUBLICATIONS

Extended European Search Report for 15759033.2 dated Oct. 4, 2017.

* cited by examiner

PAPER SHEET PROCESSING DEVICE

TECHNICAL FIELD

The present invention relates to a paper-sheet processing apparatus which processes paper sheets.

BACKGROUND ART

Paper-sheet processing apparatuses which process paper sheets have been known heretofore. There has been a demand for paper-sheet processing apparatuses each including at least two stacking units for sorting paper sheets such as banknotes to be deposited or withdrawn at a counter of a financial institution such as a bank. Examples of such a paper-sheet processing apparatus include a paper-sheet processing apparatus disclosed in WO 2009/028071, which includes an upper transport mechanism extending in a horizontal direction, a lower transport mechanism extending in the horizontal direction below the upper transport mechanism, and an intermediate transport mechanism provided between the upper and lower transport mechanisms. WO 2009/028071 also discloses that some of the paper sheets transported by the lower transport mechanism are diverted by diverters from the lower transport mechanism and fed to two staking units.

SUMMARY OF INVENTION

The paper-sheet processing apparatus as disclosed in WO 2009/028071 has been known heretofore, but there is a demand for smaller paper-sheet processing apparatuses each having two or more stacking units. This is because a bank counter or teller desk has a limited space for placing the apparatus.

The present invention has been made in view of the points mentioned above and thus provides a smaller paper-sheet processing apparatus having at least two stacking units.

A paper-sheet processing apparatus according to the present invention includes: a casing; a take-in unit configured to take in paper sheets into the casing; a recognition unit configured to recognize each of the paper sheets taken in by the take-in unit; a transport unit configured to transport the paper sheets taken in by the take-in unit, the transport unit including a horizontal transport unit configured to transport the paper sheets recognized by the recognition unit, along a substantially horizontal direction; a plurality of stacking units each positioned below the horizontal transport unit and configured to stack the paper sheets transported by the horizontal transport unit; and a plurality of stacking wheels provided correspondingly to the stacking units and used for stacking the paper sheets transported by the horizontal transport unit in the stacking units, in which: for any adjacent two stacking units among the plurality of stacking units, a rotation direction of one of the stacking wheels corresponding to one of the two stacking units and a rotation direction of the other stacking wheel corresponding to the other stacking unit are opposite to each other.

According to the present invention, for any adjacent two stacking units among a plurality of stacking units, the rotation direction of the stacking wheel corresponding to one of the adjacent two stacking units and the rotation direction of the stacking wheel corresponding to the other one of adjacent two stacking units are opposite to each other. Thus, it is not necessary to increase the length of the horizontal transport unit before the paper sheets are stacked in the stacking unit positioned on the upstream side and/or to cause the paper sheets to pass through above the stacking unit positioned on the downstream side first and then to be stacked in the stacking unit. Thus, it is made possible to reduce the length of the horizontal transport unit and thus to downsize the paper-sheet processing apparatus including at least two stacking units.

The paper-sheet processing apparatus according to the present invention may further include diverters provided correspondingly to the stacking units and each configured to divert the paper sheets transported by the horizontal transport unit.

The paper-sheet processing apparatus according to the present invention may include a reject unit provided at an end of the transport unit, the reject unit being disposed above one of the stacking units and configured to stack the paper sheets not stacked by the stacking units, the one of the stacking units being positioned on a most downstream side in a transport direction of the paper sheets.

In the paper-sheet processing apparatus according to the present invention, the horizontal transport unit includes a tilt portion tilted upward toward the reject unit.

In the paper-sheet processing apparatus according to the present invention, the take-in unit is positioned above the reject unit.

In the paper-sheet processing apparatus according to the present invention: the transport unit may include: a first transport unit configured to transport, along one side of a horizontal direction, the paper sheets taken in by the take-in unit; a second transport unit positioned below the first transport unit and configured to transport, along another side of the horizontal direction, the paper sheets transported by the first transport unit, the other side being opposite to the one side of the horizontal direction; and an intermediate transfer unit configured to connect between the first transport unit and the second transport unit, in which the recognition unit may recognize each of the paper sheets transported by the first transport unit, and the horizontal transport unit may be included in the second transport unit.

In the paper-sheet processing apparatus according to the present invention, the stacking unit has an opening at a front side and stacks the paper sheets while tilted at an angle of at least 45 degrees with respect to the horizontal direction.

In the paper-sheet processing apparatus according to the present invention, one of the adjacent two stacking units may stack the paper sheets while tilted at an angle of at least 45 degrees with respect to one side of the horizontal direction and the other stacking unit may stack the paper sheets while tilted at an angle of at least 45 degrees with respect to another side of the horizontal direction, the other side being opposite to the one side of the horizontal direction.

In the paper-sheet processing apparatus according to the present invention: the paper sheets may be sequentially fed out to one of the adjacent two stacking units in a direction having a component opposite to a transport direction of the paper sheets by the horizontal transport unit, and the paper sheets may be sequentially fed out to the other one of the adjacent two stacking units in a direction having a component of the transport direction of the paper sheets by the horizontal transport unit.

In the paper-sheet processing apparatus according to the present invention: an upper portion of one of the stacking wheels corresponding to the one of the stacking units may rotate in the direction having a component opposite to the transport direction of the paper sheets by the horizontal transport unit, and an upper portion of the other one of the stacking wheels corresponding to the other one of the stacking units may rotate in the direction having a component of the transport direction of the paper sheets by the horizontal transport unit.

In the paper-sheet processing apparatus according to the present invention: an upstream-side one of the stacking wheels corresponding to one of the stacking units positioned on an upstream side among the adjacent two stacking units may be positioned on a downstream side of the stacking unit positioned on the upstream side, and an upper portion of the upstream-side stacking wheel may rotate in a direction having a component opposite to a transport direction of the paper sheets by the horizontal transport unit as viewed from the front side, and a downstream-side one of the stacking wheels corresponding to the other one of the stacking units positioned on a downstream side among the adjacent two stacking units may be positioned on an upstream side of the stacking unit positioned on the downstream side, and an upper portion of the downstream-side stacking wheel may rotate in a direction having a component of the transport direction of the paper sheets by the horizontal transport unit as viewed from the front side.

DESCRIPTION OF EMBODIMENT

<Configuration>

Hereinafter, a description will be given of an embodiment of a paper-sheet processing apparatus according to the present invention with reference to the accompanying drawings. FIGS. 1 through 5 are diagrams for describing the embodiment of the present invention. In addition, while various paper sheets such as banknotes, gift certificates, barcode tickets, checks, and promissory notes can be cited as examples of the paper sheets to be processed by paper-sheet processing apparatus 100 of this embodiment, the representative paper sheets are banknotes.

Figure 2:
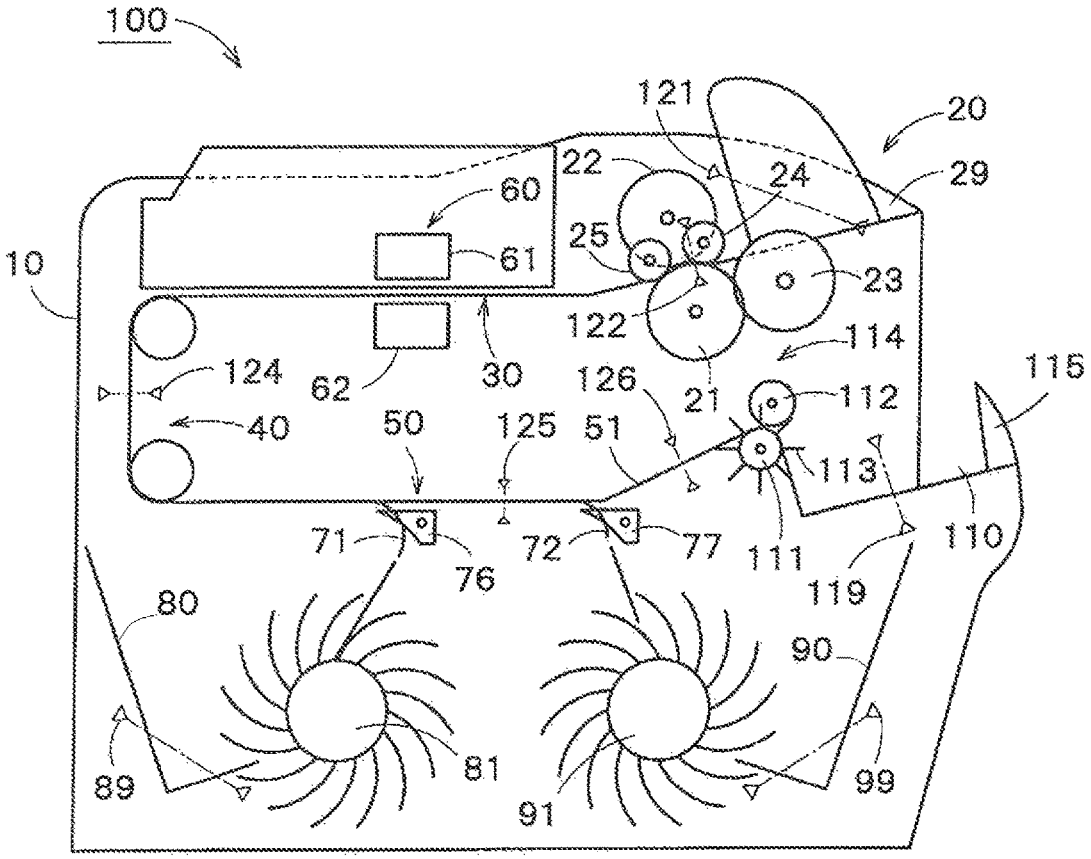
FIG. 2 is a schematic internal configuration diagram illustrating an internal configuration of the paper-sheet processing apparatus according to the present embodiment of the present invention as viewed from a front side.

As illustrated in FIG. 2, paper-sheet processing apparatus 100 of the present embodiment includes: casing 10; take-in unit 20 configured to take in paper sheets one by one into casing 10; first transport unit 30 configured to transport, along one side (leftward in FIG. 2) of a substantially horizontal direction, the paper sheets taken in by take-in unit 20; and recognition unit 60 configured to recognize the paper sheets transported by first transport unit 30. Take-in unit 20 includes mount unit 29 in which a plurality of paper sheets are placed in a stacked state, and takes in, one by one, the paper sheets placed in mount unit 29. In this embodiment, the paper sheets are to be transported along a short-edge direction, and the paper sheets are placed in mount unit 29 such that the short-edge direction extends in the left and right direction of FIG. 2 while a long-edge direction extends in the normal direction of the sheet surface of FIG. 2. Note that, the height up to the upper end of casing 10 is approximately 325 mm and the height up to the upper end of mount unit 29 is approximately 290 mm, for example.

Paper-sheet processing apparatus 100 according to the present embodiment is capable of processing (such as sorting of paper sheets, reading of serial numbers, and/or the like) approximately 1,000 paper sheets per minute, for example.

Paper-sheet processing apparatus 100 includes: second transport unit 50 positioned below first transport unit 30 and configured to transport, in the other side which is the side opposite to the one side of the abovementioned direction (rightward in FIG. 2), the paper sheets recognized by recognition unit 60; intermediate transport unit 40 positioned between first and second transport units 30 and 50 and configured to connect between first and second transport units 30 and 50; and a plurality of stacking units 80 and 90 (two stacking units in this embodiment) each positioned below second transport unit 50, configured to stack the paper sheets transported by second transport unit 50 and having an opening on the front side (see FIG. 1). Stacking units 80 and 90 are provided with stacking wheels 81 and 91 so as to correspond to stacking units 80 and 90, respectively, in order for the paper sheets transported by second transport unit 50 to be stacked in stacking units 80 and 90. Note that, although this embodiment employs a mode in which two stacking units (80 and 90) are provided with two stacking wheels (81 and 91), respectively, it is also possible to employ a mode in which three or more stacking units are provided with three or more stacking wheels respectively without being limited to the foregoing mode.

In addition, stacking units 80 and 90 are provided with push-out units 85 and 95 (see FIG. 5) for pushing out the paper sheets stacked in stacking units 80 and 90 to the front side. Push-out units 85 and 95 are configured to push out the paper sheets stacked in stacking units 80 and 90 to the outside of casing 10 through the openings on the front side of stacking units 80 and 90 after a predetermined number of paper sheets are stacked in stacking units 80 and 90. Thus, according to the present embodiment, the operator can surely cause only a predetermined number of paper sheets to be stacked in stacking units 80 and 90, and then easily remove the paper sheets from stacking units 80 and 90. Note that, push-out units 85 and 95 may be configured to push out the paper sheets stacked in stacking units 80 and 90 to the outside of casing 10 through the openings on the front side of stacking units 80 and 90 after all the paper sheets placed in mount unit 29 are sorted to stacking units 80 and 90 and/or reject unit 110 to be described hereinafter.

In this embodiment, first transport unit 30, intermediate transport unit 40 and second transport unit 50 form a substantially U-shape. The paper sheets taken in by take-in unit 20 into casing 10 are transported one by one in the order of first transport unit 30, intermediate transport unit 40 and second transport unit 50. First transport unit 30, intermediate transport unit 40 and second transport unit 50 are each composed of a combination of transport mechanisms. Each of the transport mechanisms includes a pair of or three or more transport rollers and a transport belt such as a rubber belt, for example, placed around these transport rollers in a tensioned state. Note that, this transport mechanism may be composed of a plurality of transport rollers to be in contact with paper sheets, and a driving belt such as a rubber belt for driving these transport rollers.

As illustrated in FIG. 2, take-in unit 20 includes: feed roller 21 for feeding out paper sheets into casing 10; reverse-rotation roller 22 provided so as to face feed roller 21 and configured to form a gate unit with feed roller 21 in between; kicker roller 23 for kicking out the paper sheets housed in mount unit 29 to feed roller 21; auxiliary roller 24 for surely taking in the paper sheets kicked out by kicker roller 23 into the gate unit; and pinch roller 25 having a higher frictional coefficient than feed roller 21 and used for surely taking in the paper sheets that have passed through between feed roller 21 and reverse-rotation roller 22 to the inside of first transport unit 30.

Recognition unit 60 is configured to recognize the fitness, authenticity, denomination, orientation, face/back and/or the like of each of the paper sheets including a banknote transported by first transport unit 30. Recognition unit 60 also recognizes the transported condition such as whether the banknotes are transported obliquely, whether the banknotes are transported in an overlapped condition, whether the banknotes at front and rear are transported in a chained condition and/or the like. Each recognition result made by recognition unit 60 is transmitted to control unit 150 to be described hereinafter (see FIG. 5).

Figure 1:
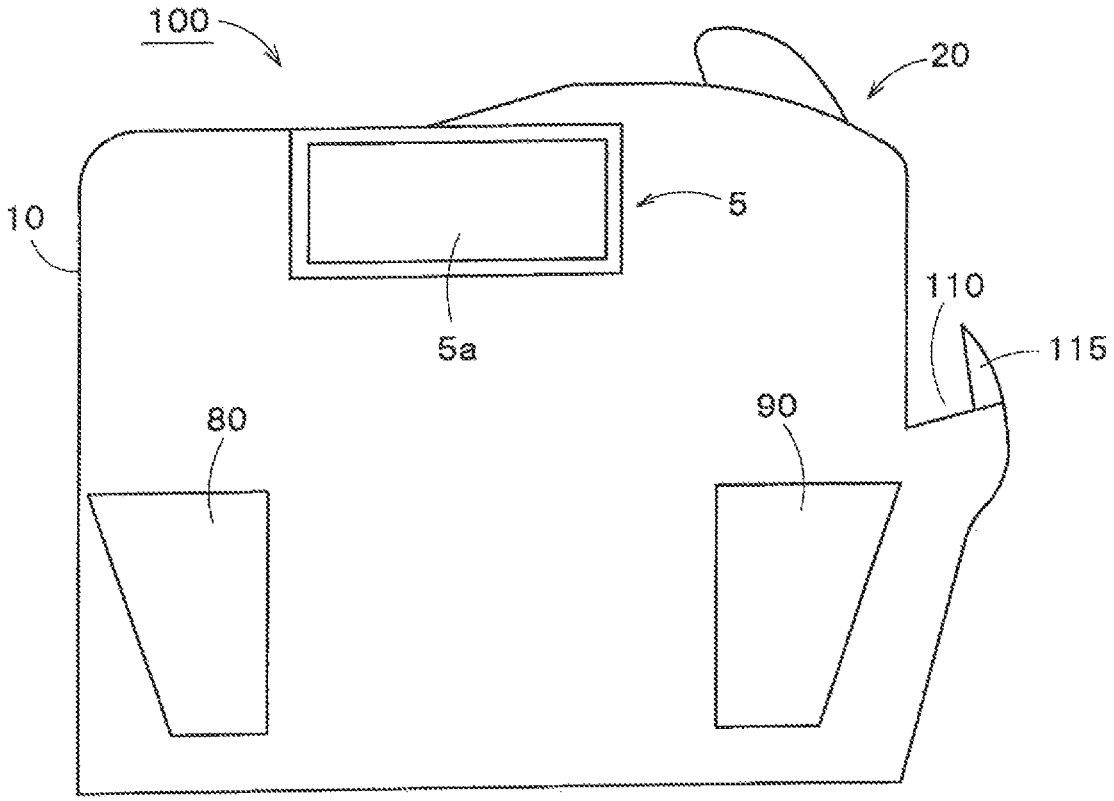
FIG. 1 is a front view of a paper-sheet processing apparatus according to an embodiment of the present invention.

As illustrated in FIGS. 1 and 2, two stacking units 80 and 90 are arranged in parallel in the left and right direction as viewed from the front side in this embodiment. Stacking units 80 and 90 are each configured to house the paper sheets that satisfy a predetermined condition according to recognition unit 60 among the paper sheets taken in into casing 10, while stacking the paper sheets in a standing state as will be described hereinafter.

In this embodiment, a description will be given while the surface side where the openings of stacking units 80 and 90 are formed is referred to as "front side." Note that, the openings of stacking units 80 and 90 may be provided at a lateral surface side of casing 10, but even in this case, the paper sheets stacked in stacking units 80 and 90 are mainly taken out in the front side direction. Second transport unit 50 in the present embodiment corresponds to "horizontal transport unit" recited in the claims. Note that, the expression, transporting a paper sheet "along the horizontal direction" means a mode in which a paper sheet is transported in a direction having a component of "horizontal direction" which includes a mode in which a paper sheet is transported in the horizontal direction in a form that the paper sheet is transported in a vertically zigzag manner, for example.

As illustrated in FIG. 2, diversion transport units 71 and 72 connecting between second transport unit 50 and stacking units 80 and 90 together are provided between second transport unit 50, and stacking units 80 and 90. Diverters 76 and 77 each having, for example, a nail-like shape and used for diverting the paper sheets transported by second transport unit 50 into diversion transport units 71 and 72 are provided so as to correspond to stacking units 80 and 90, respectively. In this embodiment, diversion transport units 71 and 72 are each shorter in length in the transport direction than a paper sheet having the shortest length in the transport direction among the paper sheets recognizable by recognition unit 60. For example, the banknote having the shortest length in the transport direction among the banknotes currently circulating in China in general is one chiao, and the length of chiao in the short-edge direction is 52 mm. Accordingly, when recognition unit 60 is configured based on an assumption that recognition unit 60 processes the banknotes circulating in China and thus capable of recognizing chiao, the length of each of diversion transport units 71 and 72 is less than 52 mm. In another example, the banknote having the shortest length in the transport direction among the banknotes currently circulating in the eurozone in general is five euros, and the length of five euros in the short-edge direction is 62 mm. Accordingly, when recognition unit 60 is configured based on an assumption that recognition unit 60 processes the banknotes circulating in the eurozone and thus capable of recognizing five euros, the length of each of diversion transport units 71 and 72 is less than 62 mm. Note that, when paper-sheet processing apparatus 100 is supposedly manufactured in a predetermined size, the length of each of diversion transport units 71 and 72 is less than 50 mm, for example.

In this embodiment, when a mode in which three or more stacking units are provided with three or more stacking wheels corresponding to the respective stacking units is employed, stacking wheels 81 and 91 are disposed in the horizontal direction between adjacent two stacking units 80 and 90 among the plurality of stacking units 80 and 90 in such a manner that stacking wheel 81 corresponds to one of adjacent two stacking units 80 and 90 while stacking wheel 91 corresponds to the other one of adjacent two stacking units 80 and 90. Regarding any adjacent two stacking units 80 and 90 among a plurality of stacking units 80 and 90, the rotation direction of stacking wheel 81 corresponding to one of two stacking units 80 and 90 and the rotation direction of stacking wheel 91 corresponding to the other one of two stacking units 80 and 90 are opposite to each other.

Regarding this point, since only two stacking units 80 and 90 are provided in the mode illustrated in FIGS. 1 through 4, stacking wheels 81 and 91 corresponding to stacking units 80 and 90 respectively are provided between two stacking units 80 and 90 in the horizontal direction, and the rotation direction of stacking wheel 81 positioned on the left as viewed from the front side and the rotation direction of stacking wheel 91 positioned on the right as viewed from the front side are opposite to each other. More specifically, stacking wheel 81 configured to rotate in a counterclockwise direction as viewed from the front side is provided at the lower right of stacking unit 80 positioned on the left as viewed from the front side, while stacking wheel 91 configured to rotate in a clockwise direction as viewed from the front side is provided at the lower left of stacking unit 90 positioned on the right as viewed from the front side. Note that, stacking wheels 81 and 91 take the paper sheets released toward the inside of stacking units 80 and 90 respectively from diversion transport units 71 and 72 into the spaces between their adjacent blade portions and cause the paper sheets to be housed in appropriate orientation and position in stacking units 80 and 90.

As illustrated in FIG. 2, reject unit 110 for stacking the paper sheets that have been neither stacked in stacking unit 80 nor 90 is provided at the end of second transport unit 50. In this embodiment, rejection unit 110 is at least partially disposed above stacking unit 90 positioned on the most downstream side in the transport direction of the paper sheets. In the mode illustrated in FIG. 2, a left portion of reject unit 110 is positioned right above stacking unit 90 positioned on a downstream side while the rest of reject unit 110 on the right is positioned on the upper right of stacking unit 90 positioned on the downstream side, but the entirety of reject unit 110 may be positioned right above stacking unit 90 as viewed from the front side.

Release unit 114 is provided at the end of second transport unit 50. Release unit 114 includes: release roller 111 configured to feed out the paper sheets to reject unit 110 from the inside of casing 10; opposite roller 112 disposed opposite to release roller 111; and elastic fin wheels 113 of rotary type provided coaxially with release roller 111. The paper sheets fed to the end of second transport unit 50 are to be released from between release roller 111 and opposite roller 112 to reject unit 110. The paper sheets that have been released in the manner described above are to be hit by elastic fin wheels 113 at the rear edges of the paper sheets and thus stacked in reject unit 110.

In addition, stopper 115 for preventing the paper sheets released from between release roller 111 and opposite roller 112 from protruding from reject unit 110 and then being released externally is provided at the end portion (right end portion in FIG. 2) of reject unit 110. Stopper 115 can be manually turned in a clockwise direction, and manually turning stopper 115 in a clockwise direction by the operator makes the paper sheets housed in reject unit 110 freely removable.

As illustrated in FIG. 2, take-in unit 20 is at least partially positioned above reject unit 110. In the mode illustrated in FIG. 2, a right portion of take-in unit 20 is positioned right above reject unit 110 while the rest of take-in unit 20 on the left is positioned on the upper left of reject unit 110, but the entirety of take-in unit 20 may be positioned right above reject unit 110 as viewed from the front side. Note that, this embodiment employs the mode in which take-in unit 20 is positioned within a region right above stacking unit 90 positioned on the most downstream side as viewed from the front side.

Second transport unit 50 of this embodiment includes tilt portion 51 tilted upward toward reject unit 110 at a downstream side in the transport direction of the paper sheets.

In this embodiment, stacking units 80 and 90 are each configured to stack paper sheets while tilted at an angle of at least 45 degrees with respect to the horizontal direction. When this embodiment employs the mode in which three or more stacking units are provided with three or more stacking wheels respectively corresponding to the stacking units, one of any adjacent two stacking units 80 and 90 stacks the paper sheets while tilted at an angle of at least 45 degrees with respect to one side of the horizontal direction and the other one of the stacking units stacks the paper sheets while tilted at an angle of at least 45 degrees with respect to the side opposite to the one side of the horizontal direction.

Regarding this point, in the mode illustrated in FIGS. 1 through 4, only two stacking units 80 and 90 are provided, and stacking unit 80 on the left as viewed from front stacks the paper sheets while tilted at an angle of at least 45 degrees with respect to one side of the horizontal direction (leftward in FIG. 2, which is the direction opposite to the transport direction of the paper sheets on second transport unit 50), and stacking unit 90 on the right as viewed from front stacks the paper sheets while tilted at an angle of at least 45 degrees with respect to the side opposite to the one side of the horizontal direction (rightward in FIG. 2, which is the same direction as the transport direction of the paper sheets on second transport unit 50). Note that, stacking units 80 and 90 are preferably configured to stack paper sheets while tilted at an angle of at least 45 degrees with respect to the horizontal direction, but stacking units 80 and 90 are more preferably configured to stack paper sheets while tilted at an angle of 60 to 70 degrees with respect to the horizontal direction and thus to stack the paper sheets in a standing state.

When the present embodiment employs the mode in which three or more stacking units are provided with three or more stacking wheels respectively corresponding to the stacking units, the paper sheets are sequentially fed out to one of adjacent two stacking units 80 and 90, which is stacking unit 80, in a direction having a component opposite to the transport direction of the paper sheets by second transport unit 50, while the paper sheets are sequentially fed out to the other one of adjacent two stacking units 80 and 90 in a direction having a component of the transport direction of the paper sheets by second transport unit 50.

Regarding this point, in the mode illustrated in FIGS. 1 through 4, only two stacking units 80 and 90 are provided, and the paper sheets are sequentially fed out to stacking unit 80 on the left as viewed from front in the direction having a component opposite to the transport direction of the paper sheets by second transport unit 50 (substantially leftward in FIG. 2), while the paper sheets are sequentially fed out to stacking unit 90 on the right as viewed from front in the direction having a component of the transport direction of the paper sheets by second transport unit 50 (substantially rightward in FIG. 2).

When this embodiment employs the mode in which three or more stacking units are provided with three or more stacking wheels respectively corresponding to the stacking units, an upper portion of stacking wheel 81 corresponding to one of any adjacent two stacking units 80 and 90 is rotated in the direction having a component opposite to the transport direction of the paper sheets by second transport unit 50, while an upper portion of stacking wheel 91 corresponding to the other one of adjacent two stacking units 80 and 90 is rotated in the direction having a component of the transport direction of the paper sheets by a horizontal transport unit.

Regarding this point, in the mode illustrated in FIGS. 1 through 4, only two stacking units 80 and 90 are provided, and stacking wheel 81 positioned on the left as viewed from the front side rotates in a counterclockwise direction while stacking wheel 91 positioned on the right as viewed from the front side rotates in a clockwise direction, so that the upper portion of stacking wheel 81 is rotated in the direction having a component opposite to the transport direction of the paper sheets by second transport unit 50 and the upper portion of stacking wheel 91 is rotated in the direction having a component of the transport direction of the paper sheets by second transport unit 50.

As illustrated in FIG. 2, take-in unit 20 is provided with sensor 121 configured to detect whether a paper sheet is placed in mount unit 29. Furthermore, sensor 122 is provided at an entrance portion of first transport unit 30 and configured to detect that a paper sheet has been surely taken into casing 10.

Sensor 124 is provided at intermediate transport unit 40, and sensor 125 is provided at a downstream side of diverter 76 at an upstream side while sensor 126 is provided at a downstream side of diverter 77 at a downstream side. More specifically, sensor 124 is provided at intermediate transport unit 40 and configured to detect all the paper sheets transported by second transport unit 50. Sensor 125 is provided at a downstream side of diverter 76 at an upstream side and configured to detect only a paper sheet that has not been diverted into diversion transport unit 71 by diverter 76 among the paper sheets transported by second transport unit 50. In addition, sensor 126 is provided at a downstream side of diverter 77 at a downstream side and configured to detect only a paper sheet that has neither been diverted into diversion transport unit 71 nor 72 by diverter 76 or 77 among the paper sheets transported by second transport unit 50.

Stacking units 80 and 90 are provided with sensors 89 and 99, respectively. Sensors 89 and 99 are configured to detect whether paper sheets are housed in stacking units 80 and 90, respectively. Moreover, reject unit 110 is provided with sensor 119, and sensor 119 is configured to detect whether a paper sheet is housed in reject unit 110.

Figure 4:
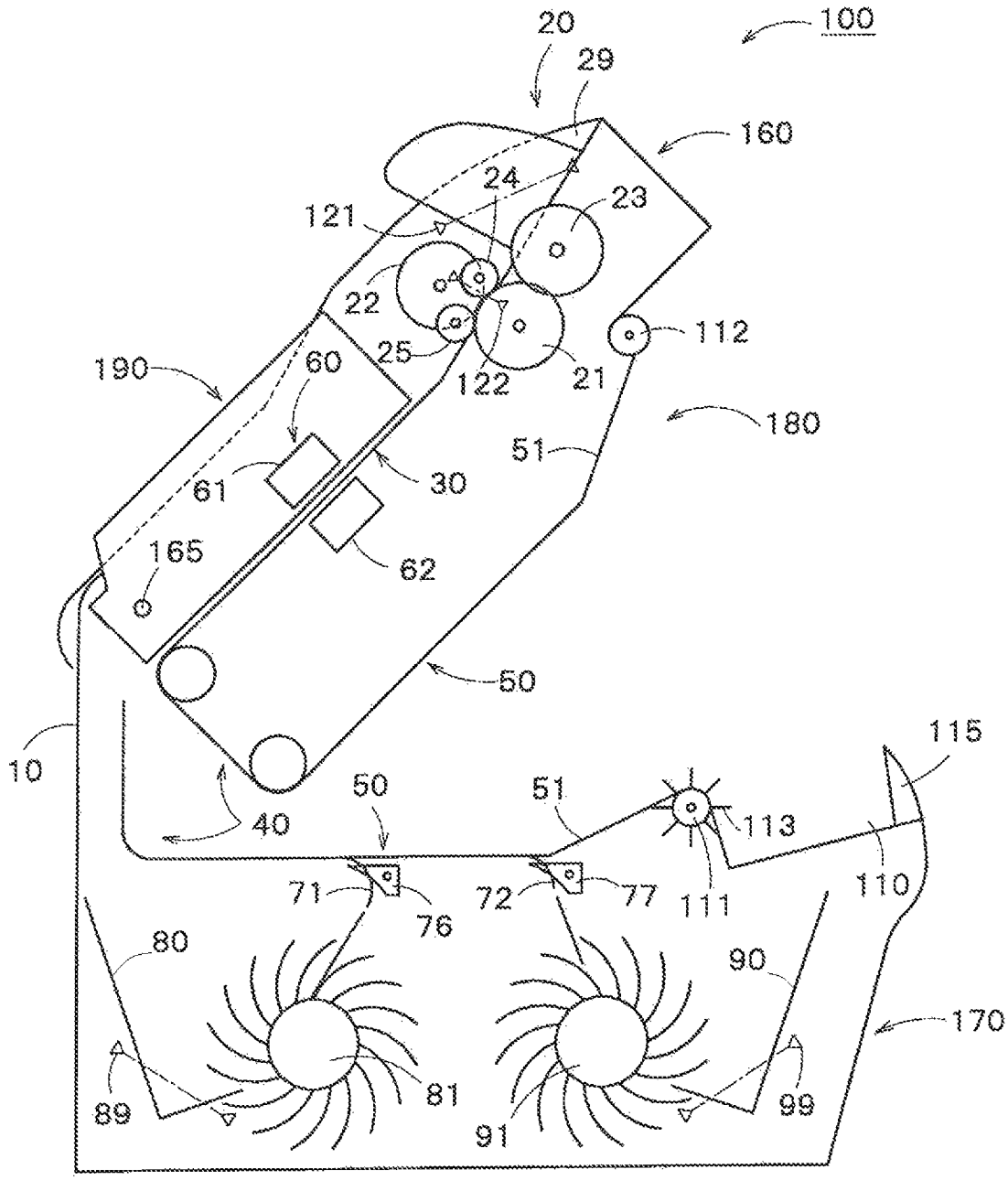
FIG. 4 is a schematic internal configuration diagram illustrating how a first unit is turned with respect to a second unit for setting the first unit in an open-state in the paper-sheet processing apparatus illustrated in FIG. 2.

Take-in unit 20, first transport unit 30 and recognition unit 60 are at least partially provided within first unit 160 positioned above (see FIG. 4). Meanwhile, second transport unit 50 and stacking units 80 and 90 are at least partially provided within second unit 170 provided below first unit 160. Note that, in this embodiment, as illustrated in FIG. 4, a description will be hereinafter given of a mode in which take-in unit 20, first transport unit 30 and recognition unit 60 are all provided within first unit 160 positioned above while stacking units 80 and 90 are all provided within second unit 170 provided below first unit 160, and second transport unit 50 is partially provided within first unit 160, and the rest of second transport unit 50 is provided within second unit 170, but it is not limited to this mode.

First unit 160 described above is configured to turn with respect to second unit 170 around first horizontal shaft 165 extending in the front and rear direction (normal direction of the sheet surface of FIG. 4). Second transport unit 50 is at least partially formed by the bottom surface of first unit 160 and the upper surface of second unit 170, which is opposite to the bottom surface of first unit 160 (when first unit 160 is in a closed-state with respect to second unit 170). Turning first unit 160 with respect to second unit 170 to set first unit 160 in an open-state makes second transport unit 50 at least partially (entirety of second transport unit 50 in the mode illustrated in FIG. 4) exposed and externally accessible. In other words, as illustrated in FIG. 4, turning first unit 160 with respect to second unit 170 to set it in an open-state makes it possible for the operator to access both part of second transport unit 50 provided in first unit 160 and part of second transport unit 50 provided in second unit 170.

Figure 3:
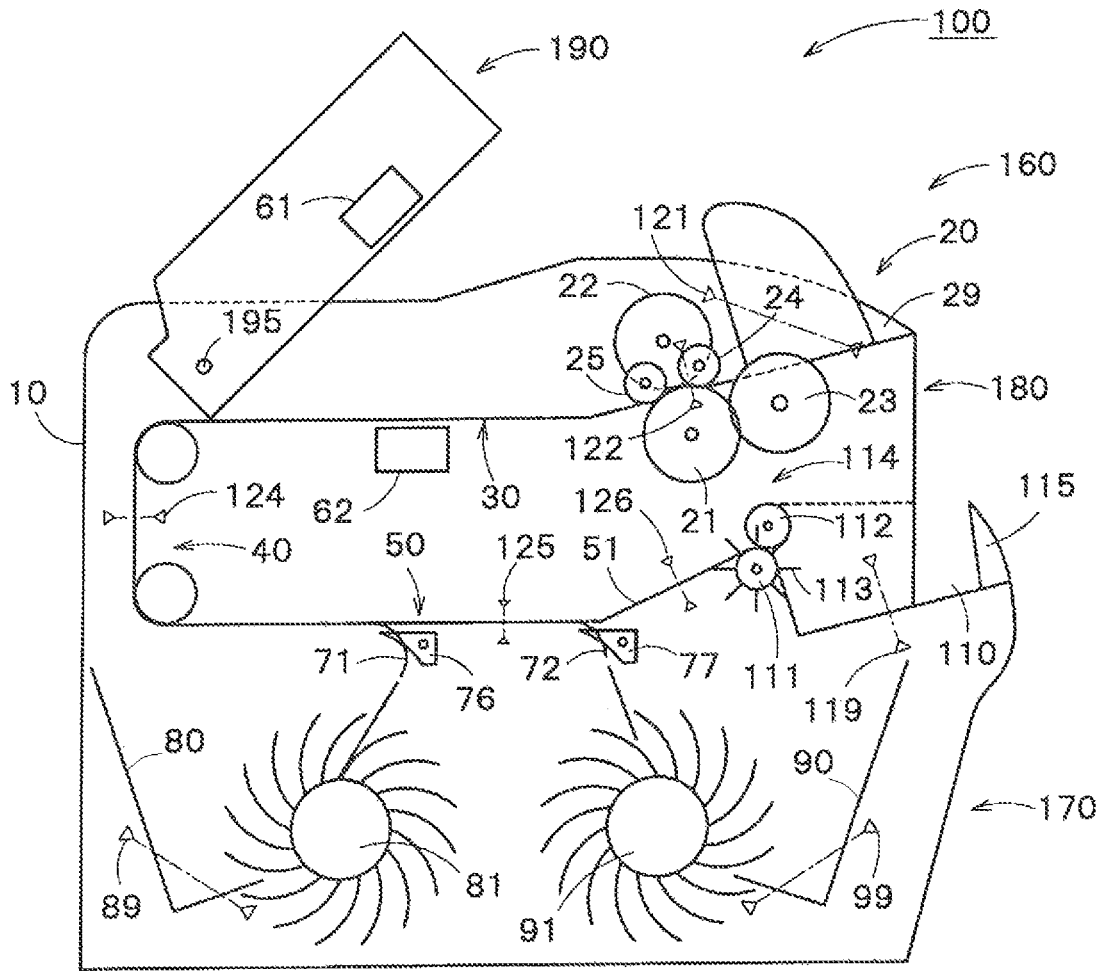
FIG. 3 is a schematic internal configuration diagram illustrating how a fourth unit is turned with respect to a third unit for setting the fourth unit in an open-state in the paper-sheet processing apparatus illustrated in FIG. 2.

As illustrated in FIG. 3, first unit 160 includes third unit 180, and fourth unit 190 positioned above third unit 180 and configured to turn with respect to third unit 180 around second horizontal shaft 195 extending in the front and rear direction. First transport unit 30 is at least partially formed by the bottom surface of fourth unit 190 and the upper surface of third unit 180, which is opposite to the bottom surface of fourth unit 190 (when fourth unit 190 is in a closed-state with respect to third unit 180). Turning fourth unit 190 with respect to third unit 180 to set fourth unit 190 in an open-state makes first transport unit 30 at least partially exposed and externally accessible. In other words, as illustrated in FIG. 3, turning fourth unit 190 with respect to third unit 180 to set it in an open-state makes it possible for the operator to access both part of first transport unit 30 provided in fourth unit 190 and part of first transport unit 30 provided in third unit 180.

Note that, regarding recognition unit 60, turning fourth unit 190 with respect to third unit 180 to set fourth unit 190 in an open-state causes upper portion 61 of recognition unit 60 to turn together with fourth unit 190, while lower portion 62 of recognition unit 60 remains in third unit 180. Thus, the inside of recognition unit 60 is also made accessible in this embodiment.

Moreover, in this embodiment, turning first unit 160 with respect to second unit 170 to set first unit 160 in an open-state (see FIG. 4) as described above makes intermediate transport unit 40 at least partially (entirety of intermediate transport unit 40 in the mode illustrated in FIG. 4) accessible. In other words, as illustrated in FIG. 4, intermediate transport unit 40 is at least partially formed by a side surface of second unit 170 and a side surface of first unit 160, which is opposite to the side surface of second unit 170 (when first unit 160 is in a closed-state with respect to second unit 170). Accordingly, turning first unit 160 with respect to second unit 170 to set first unit 160 in an open-state makes intermediate transport unit 40 at least partially exposed and makes it possible for the operator to access both part of intermediate transport unit 40 provided in first unit 160 and part of intermediate transport unit 40 provided in second unit 170.

Figure 6A:
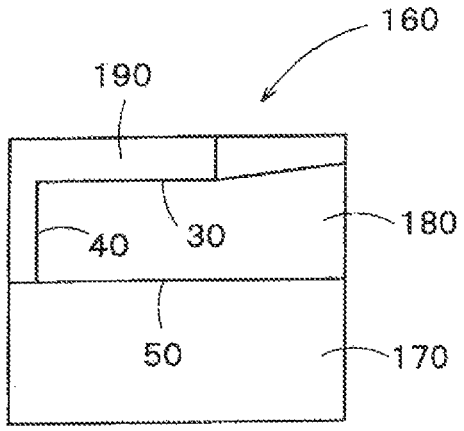
FIG. 6A is a simplified front view illustrating a state where the first unit is in a closed-state with respect to the second unit while the fourth unit is also in a closed-state with respect to the third unit in a variation of the embodiment of the present invention.
Figure 6B:
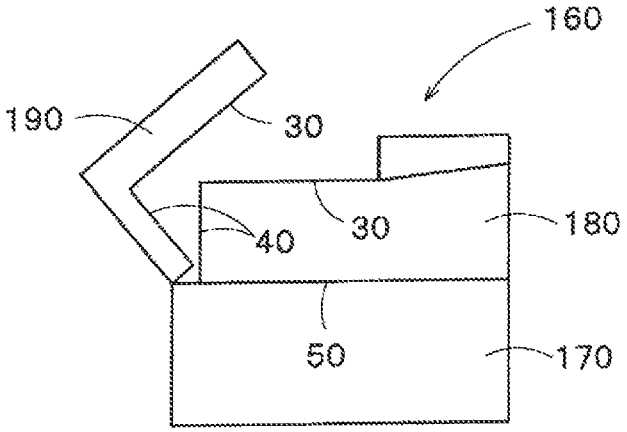
FIG. 6B is a simplified front view illustrating a state where the first unit is in a closed-state with respect to the second unit while the fourth unit is in an open-state with respect to the third unit in the variation of the embodiment of the present invention.
Figure 6C:
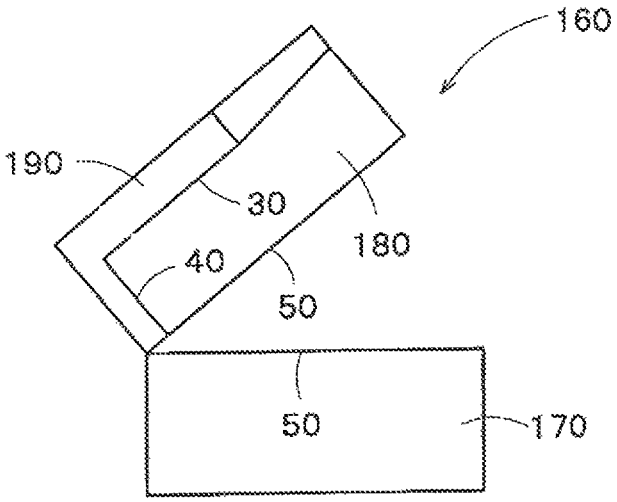
FIG. 6C is a simplified front view illustrating a state where the first unit is in an open-state with respect to the second unit while the fourth unit is in a closed-state with respect to the third unit in the variation of the embodiment of the present invention.
Figure 7A:
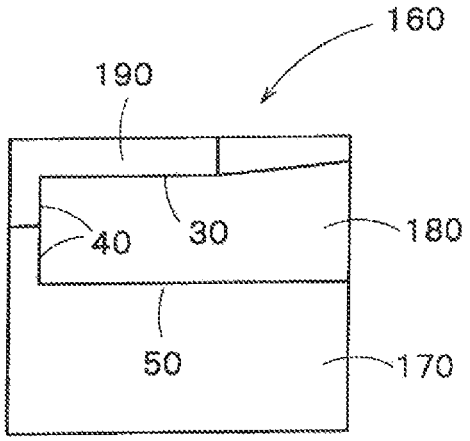
FIG. 7A is a simplified front view illustrating a state where the first unit is in a closed-state with respect to the second unit while the fourth unit is also in a closed-state with respect to the third unit in another variation of the embodiment of the present invention.
Figure 7B:
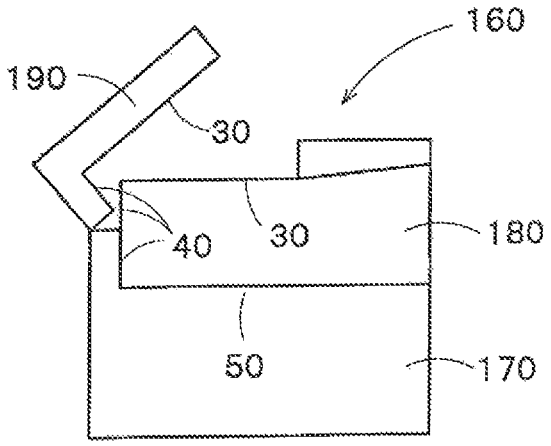
FIG. 7B is a simplified front view illustrating a state where the first unit is in a closed-state with respect to the second unit while the fourth unit is in an open-state with respect to the third unit in the other variation of the embodiment of the present invention.
Figure 7C:
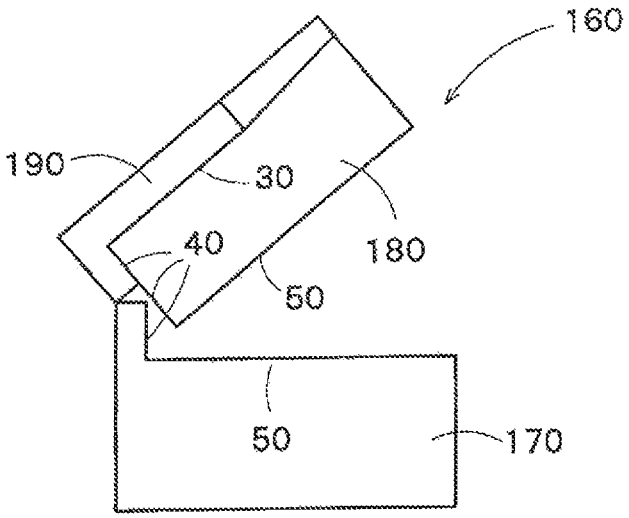
FIG. 7C is a simplified front view illustrating a state where the first unit is in an open-state with respect to the second unit while the fourth unit is in a closed-state with respect to the third unit in the other variation of the embodiment of the present invention.

Note that, the mode to be employed is not limited to the mode mentioned above, and it is also possible to employ a mode in which turning fourth unit 190 with respect to third unit 180 to set fourth unit 190 in an open-state makes intermediate transport unit 40 and first transport unit 30 accessible (see FIG. 6B), for example. Note that, in this mode, turning first unit 160 with respect to second unit 170 to set it in an open-state makes second transport unit 50 accessible (see FIG. 6C). Furthermore, it is also possible to employ a mode in which turning first unit 160 with respect to second unit 170 to set it in an open-state makes some of intermediate transport unit 40, and second transport unit 50 accessible (see FIG. 7C), while turning fourth unit 190 with respect to third unit 180 to set it in an open-state makes the rest of intermediate transport unit 40, and first transport unit 30 accessible (see FIG. 7B).

First horizontal shaft 165 used for turning first unit 160 with respect to second unit 170 and second horizontal shaft 195 used for turning fourth unit 190 with respect to third unit 180 may be the same horizontal shaft or may be disposed in proximity to each other. This embodiment employs the mode in which first and second horizontal shafts 165 and 195 are disposed close to each other. More specifically, first horizontal shaft 165 is positioned in an upper-left end region and second horizontal shaft 195 is positioned in a more inward region than first horizontal shaft 165 (lower right region in FIG. 2) as viewed from front.

Note that, in the embodiment, the maximum value of the length of an inaccessible part of first transport unit 30, second transport unit 50, and intermediate transport unit 40 when first unit 160 is turned with respect to second unit 170 to set it in an open-state (see FIG. 4) while fourth unit 190 is turned with respect to third unit 180 to set it in an open-state is shorter than a paper sheet having the shortest length in the transport direction among the paper sheets recognizable by recognition unit 60. In the case of the example described above, when recognition unit 60 is configured based on the assumption that recognition unit 60 processes the banknotes circulating in China and thus capable of recognizing chiao, the maximum value of the length of the inaccessible part of first transport unit 30, second transport unit 50 and intermediate transport unit 40 when first unit 160 is turned with respect to second unit 170 to set it in an open-state while fourth unit 190 is turned with respect to third unit 180 to set it in an open-state is less than 52 mm. In addition, when recognition unit 60 is configured based on the assumption that recognition unit 60 processes the banknotes circulating in the euro-zone and thus capable of recognizing five euros, the maximum value of the length of the inaccessible part of first transport unit 30, second transport unit 50, and intermediate transport unit 40 when first unit 160 is turned with respect to second unit 170 to set it in an open-state while fourth unit 190 is turned with respect to third unit 180 to set it in an open-state is less than 62 mm. Note that, when paper-sheet processing apparatus 100 is supposedly manufactured in a predetermined size, the length of the inaccessible part of first transport unit 30, second transport unit 50, and intermediate transport unit 40 is less than 50 mm.

As illustrated in FIG. 1, paper-sheet processing apparatus 100 of the present embodiment includes, on the front side of casing 10, operation display unit 5 configured to receive input from the operator and also to display a variety of information and composed of a touch panel or the like, for example. Operation display unit 5 may display position information indicating where a paper sheet has jammed in a case where a paper sheet has jammed, or release information indicating how to remove the jammed paper sheet, such as which unit is to be opened for removing the jammed paper sheet, or more specifically, whether to open first unit 160 with respect to second unit 170, and/or whether to open fourth unit 190 with respect to third unit 180. Note that, this embodiment employs the mode in which operation display unit 5 serves both roles as an operation unit for receiving input from the operator and as a display unit for displaying a variety of information, but without being limited to this mode, it is also possible to provide the operation unit and display unit, separately. Meanwhile, in this embodiment, employing operation display unit 5 configured to serve both the roles as the operation unit and display unit eliminates the need for providing both of the operation unit and display unit, which makes it possible to further downsize paper-sheet processing apparatus 100. For example, operation display unit 5 includes display screen 5*a* of a size approximately equal to seven inches.

Figure 5:
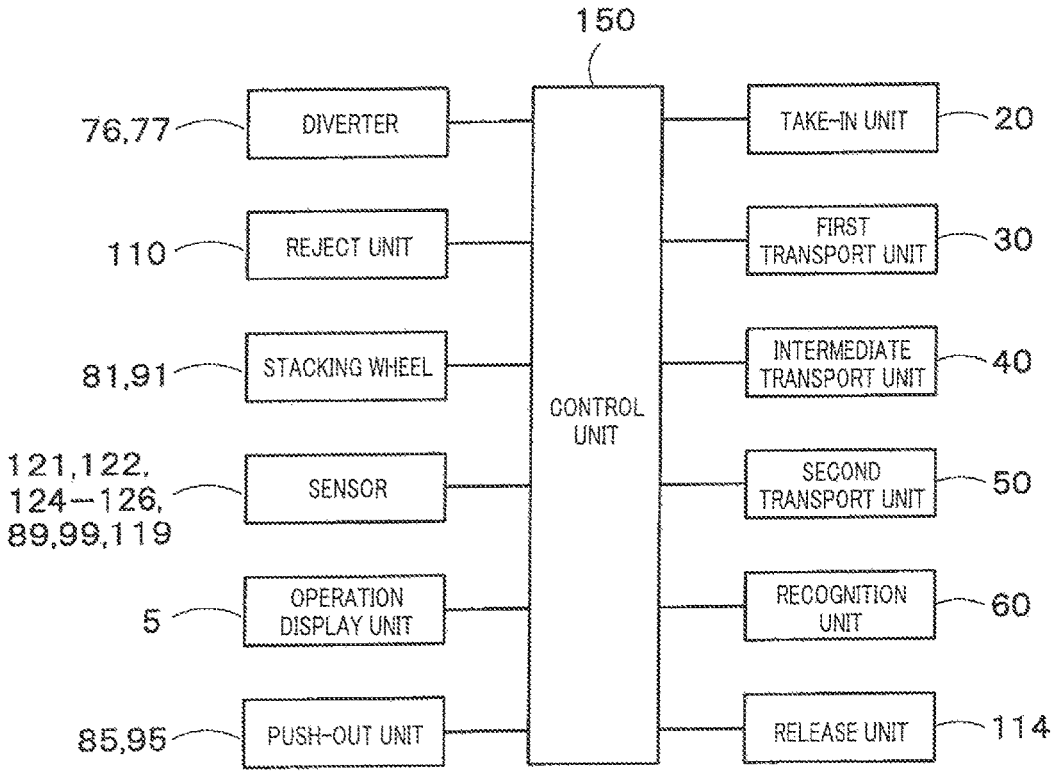
FIG. 5 is a control block diagram for describing a connection state in the paper-sheet processing apparatus according to the embodiment of the present invention.

As illustrated in FIG. 5, paper-sheet processing apparatus 100 includes control unit 150 configured to control paper-sheet processing apparatus 100. As illustrated in FIG. 5, the following components are connected to control unit 150: take-in unit 20, first transport unit 30, intermediate transport unit 40, second transport unit 50, recognition unit 60, release unit 114, diverters 76 and 77, reject unit 110, stacking wheels 81 and 91, various sensors 121 to 126, and 89, 99, and 119, operation display unit 5 and push-out units 85 and 95. Control unit 150 is configured to acquire information from or to give an instruction to take-in unit 20, first transport unit 30, intermediate transport unit 40, second transport unit 50, recognition unit 60, release unit 114, diverters 76 and 77, reject unit 110, stacking wheels 81 and 91, various sensors 121 to 126, and 89, 99, and 119, operation display unit 5 and push-out units 85 and 95.

<Method>

[Transport Mode]

A description will be given of how paper sheets are transported in paper-sheet processing apparatus 100 of the present embodiment.

First, the operator places a plurality of paper sheets in mount unit 29 of take-in unit 20 in a stacked manner such that the long-edge direction of the paper sheets is oriented in the front and rear direction (normal direction of the sheet surface of FIG. 2). The paper sheets stacked in mount unit 29 are taken into casing 10 one by one by kicker roller 23, auxiliary roller 24, feed roller 21, reverse-rotation roller 22, and pinch roller 25 of take-in unit 20. The paper sheets taken into casing 10 are transported by transport units 30, 40, and 50. More specifically, the paper sheets taken into casing 10 are transported in the order of first transport unit 30, intermediate transport unit 40, and second transport unit 50.

While the paper sheets are transported by first transport unit 30, recognition unit 60 detects the fitness, authenticity, denomination, orientation, face/back, transport condition and/or the like of each of the paper sheets. The following paper sheets are considered to be fed to rejection unit 110: the paper sheets that are unrecognizable by recognition unit 60 (such as unrecognizable note or irregularly-transported note such as oblique transport, overlapped transport, or chained transport), the paper sheets that have been recognized but considered as irregular notes (counterfeit note or suspect note), and the paper sheets that do not satisfy a predetermined condition. Meanwhile, the paper sheets determined by recognition unit 60 to satisfy a predetermined condition are to be stacked in stacking units 80 and 90.

The paper sheets transported by first transport unit 30 are fed to second transport unit 50 from first transport unit 30 via intermediate transport unit 40. Among the paper sheets transported by second transport unit 50, the paper sheets to be stacked in staking unit 80 on the left as viewed from front are diverted into diversion transport unit 71 by diverter 76 on the upstream side while the paper sheets to be stacked in staking unit 90 on the right as viewed from front are diverted into diversion transport unit 72 by diverter 77 on the downstream side.

The paper sheets transported by diversion transport unit 71 on the left as viewed from front are taken into the spaces between adjacent blade portions of stacking wheel 81 rotating in a counterclockwise direction, and sequentially stacked in stacking unit 80 on the left as viewed from front in a direction having a component opposite to the transport direction of the paper sheets by second transport unit 50 (substantially leftward in FIG. 2). In this case, the paper sheets are stacked in stacking unit 80 on the left as viewed from front while tilted at an angle of at least 45 degrees or preferably 60 to 70 degrees with respect to the left side (one side) of the horizontal direction (i.e., in a standing state).

The paper sheets transported by diversion transport unit 72 on the right as viewed from front are taken into the spaces between adjacent blade portions of stacking wheel 91 rotating in a clockwise direction, and sequentially stacked in stacking unit 90 on the right as viewed from front in a direction having a component of the transport direction of the paper sheets by second transport unit 50 (substantially rightward in FIG. 2). In this case, the paper sheets are stacked in stacking unit 90 on the right as viewed from front while tilted at an angle of at least 45 degrees or preferably 60 to 70 degrees with respect to the right side (the side opposite to the one side) of the horizontal direction (i.e., in a standing state).

Among the paper sheets transported by second transport unit 50, the paper sheets determined to be fed to rejection unit 110 are transported to the end of second transport unit 50 via tilt portion 51 tilted above second transport unit 50 without being diverted into diversion transport unit 71 or 72 by diverter 76 or 77. The paper sheets fed to the end of second transport unit 50 are released from between release roller 111 and opposite roller 112 but the rear edges of the paper sheets are hit by elastic fin wheels 113 of rotary type provided near release roller 111 during this release and are thus stacked in reject unit 110.

[Release Mode]

Next, a description will be given of how casing 10 is opened in a case where a paper sheet has jammed, for example.

For example, in a case where a paper sheet has jammed at first transport unit 30, the information indicating that a paper sheet has jammed at first transport unit 30 (position information) is displayed by operation display unit 5 (see FIG. 1). The operator who has received the result, as illustrated in FIG. 3, turns fourth unit 190 with respect to third unit 180 around second horizontal shaft 195 to set fourth unit 190 in an open-state, thereby making it possible for the operator to access the paper sheet that has jammed at first transport unit 30. The operator then removes from first transport unit 30 the paper sheet that has jammed at first transport unit 30. Note that, operation display unit 5 may display the information indicating turning of fourth unit 190 with respect to third unit 180 to set it in an open-state (release information) in addition to or instead of the information indicating that the paper sheet has jammed at first transport unit 30 (position information) as described above.

For example, in a case where a paper sheet has jammed at second transport unit 50, the information indicating that a paper sheet has jammed at second transport unit 50 (position information) is displayed by operation display unit 5 (see FIG. 1). The operator who has received the result, as illustrated in FIG. 4, turns first unit 160 with respect to second unit 170 around first horizontal shaft 165 to set first unit 160 in an open-state, thereby making it possible for the operator to access the paper sheet that has jammed at second transport unit 50. The operator then removes from second transport unit 50 the paper sheet that has jammed at second transport unit 50. Note that, operation display unit 5 may display the information indicating turning of first unit 160 with respect to second unit 170 to set it in an open-state (release information) in addition to or instead of the information indicating that the paper sheet has jammed at second transport unit 50 (position information).

For example, in a case where a paper sheet has jammed at intermediate transport unit 40, the information indicating that a paper sheet has jammed at intermediate transport unit 40 (position information) is displayed by operation display unit 5 (see FIG. 1). The operator who has received the result, as illustrated in FIG. 4, turns first unit 160 with respect to second unit 170 around first horizontal shaft 165 to set first unit 160 in an open-state, thereby making it possible for the operator to access the paper sheet that has jammed at intermediate transport unit 40. The operator then removes from intermediate transport unit 40 the paper sheet that has jammed at intermediate transport unit 40. Note that, operation display unit 5 may display the information indicating turning of first unit 160 with respect to second unit 170 to set it in an open-state (release information) in addition to or instead of the information indicating that the paper sheet has jammed at intermediate transport unit 40 (position information) as described above.

For example, in a case where a paper sheet has jammed at first transport unit 30, second transport unit 50 and/or intermediate transport unit 40, the information indicating that a paper sheet has jammed at first transport unit 30 (position information) and the information indicating that a paper sheet has jammed at second transport unit 50 and/or intermediate transport unit 40 (position information) are displayed by operation display unit 5 (see FIG. 1). The operator who has received the result, as illustrated in FIG. 3, turns fourth unit 190 with respect to third unit 180 around second horizontal shaft 195 to set fourth unit 190 in an open-state, thereby making it possible for the operator to access the paper sheet that has jammed at first transport unit 30. The operator then removes from first transport unit 30 the paper sheet that has jammed at first transport unit 30. In addition, as illustrated in FIG. 4, the operator turns first unit 160 with respect to second unit 170 around first horizontal shaft 165 to set first unit 160 in an open-state, thereby making it possible for the operator to access the paper sheet that has jammed at second transport unit 50 and/or intermediate unit 40. The operator then removes from intermediate transport unit 40 the paper sheet that has jammed at second transport unit 50 and/or intermediate transport unit 40. Note that, operation display unit 5 may display the information indicating turning of first unit 160 with respect to second unit 170 to set it in an open-state (release information) and/or the information indicating turning of fourth unit 190 with respect to third unit 180 to set it in an open-state (release information) in addition to or instead of the information indicating that the paper sheet has jammed at first transport unit 30, second transport unit 50 and/or intermediate transport unit 40 (position information) as described above.

Note that, in a case where a paper sheet has jammed at first transport unit 30, second transport unit 50 and/or intermediate transport unit 40, the information indicating that a paper sheet has jammed at first transport unit 30 (position information) and the information indicating that a paper sheet has jammed at second transport unit 50 and/or intermediate transport unit 40 (position information) are not necessarily displayed by operation display unit 5 at the same time (see FIG. 1). For example, the information indicating that a paper sheet has jammed at first transport unit 30 (position information) may be displayed first, and the information indicating that a paper sheet has jammed at second transport unit 50 and/or intermediate transport unit 40 (position information) is displayed after removal of the jammed paper sheet from first transport unit 30. Reversely, the information indicating that a paper sheet has jammed at second transport unit 50 and/or intermediate transport unit 40 (position information) may be displayed first, and the information indicating that a paper sheet has jammed at first transport unit 30 (position information) is displayed after removal of the jammed paper sheet from second transport unit 50 and/or intermediate transport unit 40.

Furthermore, in a case where a paper sheet has jammed at first transport unit 30, second transport unit 50, and/or intermediate transport unit 40, operation display unit 5 may display at the same time the information indicating setting of first unit 160 to an open-state with respect to second unit 170 (release information) and the information indicating setting of fourth unit 190 to an open-state with respect to third unit 180 (release information), but it is not limited to this mode. For example, the information indicating setting of fourth unit 190 to an open-state with respect to third unit 180 (release information) may be displayed first, and the information indicating setting of first unit 160 to an open-state with respect to second unit 170 (release information) is displayed after removal of the jammed paper sheet from the first transport unit 30. Reversely, the information indicating setting of first unit 160 to an open-state with respect to second unit 170 (release information) may be displayed first, and the information indicating setting of fourth unit 190 to an open-state with respect to third unit 180 (release information) is displayed after removal of the jammed paper sheet from the second transport unit 50 and/or intermediate transport unit 40.

Note that, in a case where a paper sheet has jammed at diversion transport unit 71 or 72, the operator may put his or her hand into stacking unit 80 or 90 having an opening on the front side (see FIG. 1), to remove the jammed paper sheet, or as illustrated in FIG. 4, first unit 160 may be turned with respect to second unit 170 to set first unit 160 in an open-state for the operator to access the paper sheet from above diversion transport unit 71 or 72 for removal of the jammed paper sheet.

Note that, operation display unit 5 may keep displaying the position information and/or release information, for example, until the jammed paper sheets are removed from all of first transport unit 30, second transport unit 50, intermediate transport unit 40, and diversion transport units 71 and 72. In this case, removal of the jammed paper sheets from all of first transport unit 30, second transport unit 50, intermediate transport unit 40, and diversion transport units 71 and 72 causes the displayed information to go off, and paper-sheet processing apparatus 100 becomes available again. Note that, in a case where a paper sheet has jammed at any of first transport unit 30, second transport unit 50, intermediate transport unit 40, and diversion transport units 71 and 72, the paper-sheet processing apparatus may provide an audio notification indicating the jam instead of or in addition to the displaying of the information by operation display unit 5.

<Operational Effects>

Next, a description will be given of the effects to be brought about by paper-sheet processing apparatus 100 according to the present embodiment, which have not been presented yet or which are particularly important.

According to the present embodiment, for any adjacent two stacking units 80 and 90 among a plurality of stacking units 80 and 90, the rotation direction of stacking wheel 81 corresponding to one of adjacent two stacking units 80 and 90 and the rotation direction of stacking wheel 91 corresponding to the other one of adjacent two stacking units 80 and 90 are opposite to each other. This mode eliminates the need for increasing the length of second transport unit 50 before the paper sheets are stacked in stacking unit 80 and/or for causing the paper sheets to pass through above stacking unit 90 first and then to be stacked in stacking unit 90. Thus, the length of second transport unit 50 can be reduced. This point will be described. Supposedly, when the rotation directions of the stacking wheels are the same, all the stacking wheels are positioned left or right of the stacking units as viewed from the front side. Supposedly, in a case where all the stacking wheels are positioned left of the stacking units as viewed from the front side, it is necessary to increase the length of second transport unit 50 before the paper sheets are stacked in the stacking unit positioned on the most upstream side. This is because control unit 150 needs to secure some time required for receiving the recognition result of a paper sheet from recognition unit 60, determining a transport destination of the paper sheet, and controlling an applicable one of diverters 76 and 77. Meanwhile, in a case where all the stacking wheels are positioned right of the stacking units as viewed from the front side, it is necessary to cause a paper sheet to pass through above the stacking unit positioned on the most downstream side first and then to be stacked in this stacking unit, and the length of second transport unit 50 becomes long accordingly in this case. Regarding this point, according to the present embodiment, stacking wheel 81 is positioned on the downstream side (right side) of stacking unit 80 positioned on the most upstream side and an upper part of stacking wheel 81 rotates in a direction having a component opposite to the transport direction of the paper sheets by second transport unit (horizontal transport unit) 50 (rotates in a counterclockwise direction in this embodiment) as viewed from the front side. In addition, stacking wheel 91 is positioned on the upstream side (left side) of stacking unit 90 positioned on the most downstream side and an upper part of stacking wheel 91 rotates in a direction having a component of the transport direction of the paper sheets by second transport unit (horizontal transport unit) 50 (rotates in a clockwise direction in this embodiment) as viewed from the front side. Thus, it is not necessary to increase the length of second transport unit 50 before the paper sheets are staked in stacking unit 80 or to cause a paper sheet to pass through above stacking unit 90 first and then to be stacked in the stacking unit 90. Thus, the length of second transport unit 50 can be reduced.

As a result, according to the present embodiment, paper-sheet processing apparatus 100 including at least two stacking units 80 and 90 can be further reduced in size. As a recap, the positioning of stacking wheel 81 on the downstream side (right side) of stacking unit 80 positioned on the most upstream side among a plurality of stacking units makes it possible for the transport path from recognition unit 60 to very first diverter 76 to include the transport path positioned above stacking unit 80 positioned on the most upstream side. Thus, the length of the transport path from recognition unit 60 to stacking unit 80 can be reduced. In addition, the positioning of stacking wheel 91 on the upstream side (left side) of stacking unit 90 positioned on the most downstream side among a plurality of stacking units makes it possible to reduce the length of the transport path by the horizontal length of stacking unit 90 positioned on the most downstream side.

According to the present embodiment, reject unit 110 is provided above stacking unit 90 positioned on the most downstream side in the transport direction of the paper sheets and partially positioned inward of casing 10. The positioning of reject unit 110 partially inward of casing 10 makes it possible to reduce the horizontal size of paper-sheet processing apparatus 100 and thereby to further downsize paper-sheet processing apparatus 100. Note that, the positioning of reject unit 110 partially inward of casing 10 to reduce the horizontal size of paper-sheet processing apparatus 100 is a configuration enabled by, as to stacking unit 90, the positioning of stacking wheel 91 on the upstream side (left side) of stacking unit 90. More specifically, as viewed from the front side, the positioning of stacking wheel 91 on the upstream side (left side) of stacking unit 90 positioned on the downstream side and the rotation of the upper part of stacking wheel 91 in the direction having a component of the transport direction of the paper sheets by second transport unit 50 (rotates in a clockwise direction in this embodiment) eliminate the need for transporting above stacking unit 90 the paper sheets to be stacked in stacking unit 90. Thus, reject unit 110 can be positioned in the space formed above stacking unit 90. As a recap, positioning stacking wheel 91 on the upstream side (leftward) of stacking unit 90 positioned on the most downstream side among a plurality of stacking units allows reject unit 110 to be disposed above stacking unit 90, thus enabling downsizing of the apparatus.

Moreover, reject unit 110 is preferably configured such that a paper sheet is dropped from above reject unit 110 in order that the paper sheet can be surely housed in reject unit 110 even when the condition of the paper sheet is poor (e.g., unfit note). According to the present embodiment, second transport unit 50 includes tilt portion 51 tilted upward toward reject unit 110 at a downstream side in the transport direction of paper sheets. Thus, as in this embodiment, even when the mode in which reject unit 110 is provided above stacking unit 90 positioned on the most downstream side in the transport direction of paper sheets is employed, the paper sheets can be dropped from above when transported to reject unit 110.

As a result, reject unit 110 can be provided above stacking unit 90 positioned on the most downstream side in the transport direction of paper sheets, so that paper-sheet processing apparatus 100 can be reduced in size in the horizontal direction.

In the present embodiment, take-in unit 20 is positioned above reject unit 110. This positioning results from the positioning of reject unit 110 partially inward of casing 10. Meanwhile, employing this mode makes it possible to reduce the horizontal size of paper-sheet processing apparatus 100 and thus to further downsize paper-sheet processing apparatus 100.

Moreover, in this embodiment, the paper sheets are stacked while tilted at an angle of at least 45 degrees with respect to the horizontal direction. More specifically, the paper sheets can be stacked in a standing state tilted at an angle of at least 45 degrees or preferably 60 to 70 degrees with respect to the left side (one side) of the horizontal direction in stacking unit 80 on the left as viewed from front. Moreover, the paper sheets can be stacked in a standing state tilted at an angle of at least 45 degrees or preferably 60 to 70 degrees with respect to the right side (side opposite to the one side) of the horizontal direction in stacking unit 90 on the right as viewed from front. As a result, the vertical size of paper-sheet processing apparatus 100 can be reduced. This point will be described. In a case where paper sheets are stacked vertically in each stacking unit as disclosed in WO 2009/028071, it is necessary to provide a certain distance from the bottom end of a stacking wheel to the uppermost one of the stacked paper sheets. As a result, it is necessary to increase the vertical size of paper-sheet processing apparatus 100 by a certain amount. Meanwhile, according to the present embodiment, the paper sheets can be stacked in a standing state tilted leftward in stacking unit 80 while the paper sheets can be stacked in a standing state tilted rightward in stacking unit 90, so that, unlike the case where paper sheets are stacked vertically in a stacking unit, it is not necessary to provide a certain distance from the bottom end of a stacking wheel to the uppermost one of the stacked paper sheets, thus making it possible to reduce the vertical size of paper-sheet processing apparatus 100. Thus, paper-sheet processing apparatus 100 can be further downsized. Note that, reducing the size in the vertical direction makes it easier for the operator who works while sitting to handle paper-sheet processing apparatus 100, so that the operator can increase the work efficiency.

In the present embodiment, the paper sheets are sequentially fed out to stacking unit 80 on the left as viewed from front (one of adjacent two stacking units 80 and 90) in a direction having a component opposite to the transport direction of the paper sheets by second transport unit 50 (substantially leftward in FIG. 2). Meanwhile, the paper sheets are sequentially fed out to stacking unit 90 on the right as viewed from front (the other one of adjacent two stacking units 80 and 90) in a direction having a component of the transport direction of the paper sheets by second transport unit 50 (substantially rightward in FIG. 2). For this reason, the paper sheets can be stacked so as to be packed leftward in stacking unit 80 on the left as viewed from front while the paper sheets can be stacked so as to be packed rightward in stacking unit 90 on the right as viewed from front. Thus, the stacked paper sheets can be easily taken out from the inside of each of stacking units 80 and 90.

Note that, in this embodiment, stacking wheel 81 positioned left as viewed from the front side rotates in a counterclockwise direction, takes in a paper sheet into a space between adjacent blade portions, and releases the paper sheet leftward as viewed from the front side, so that the paper sheets can be more surely stacked so as to be packed leftward in stacking unit 80 on the left as viewed from front. Meanwhile, stacking wheel 91 positioned right as viewed from the front side rotates in a clockwise direction, takes a paper sheet in a space between adjacent blade portions, and releases the paper sheet rightward as viewed from the front side, so that the paper sheets can be more surely stacked so as to be packed rightward in stacking unit 90 on the right as viewed from front.

In the present embodiment, as illustrated in FIG. 4, first unit 160 including take-in unit 20, first transport unit 30 and recognition unit 60 turns with respect to second unit 170 including second transport unit 50 and stacking units 80 and 90, around first horizontal shaft 165 extending in "front and rear direction." Thus, paper-sheet processing apparatus 100 without requiring an extra space on the rear side can be provided. This point will be described. Heretofore, the mode has been employed in which an upper unit is turned with respect to a lower unit from the front side to the rear side around a horizontal shaft extending in the left and right direction as illustrated in FIGS. 4 and 5 of Japanese Patent No. 4896997. For this reason, the paper-sheet processing apparatus cannot be disposed with the rear surface thereof placed on the wall, for example, in considering a situation where the upper unit is turned with respect to the lower unit in a case where a paper sheet has jammed at a transport unit. Accordingly, the paper-sheet processing apparatus needs to be disposed with a space interposed between the rear surface of the paper-sheet processing apparatus and the wall or the like, resulting in requiring an extra space on the rear side of the paper-sheet processing apparatus. Meanwhile, according to the present embodiment, first unit 160 including take-in unit 20, first transport unit 30 and recognition unit 60 turns with respect to second unit 170 including second transport unit 50 and stacking units 80 and 90 around first horizontal shaft 165 extending in the front and rear direction. Thus, even when a situation is taken into consideration where first unit 160 is turned with respect to second unit 170 around first horizontal shaft 165 in a case where a paper sheet has jammed at second transport unit 50 and/or intermediate transport unit 40 (see FIG. 4), unlike the related art, no space has to be provided on the rear side of the paper-sheet processing apparatus, and paper-sheet processing apparatus 100 without requiring an extra space on the rear side thereof can be provided. Note that, placement of the rear surface of paper-sheet processing apparatus 100 on the wall makes it possible to secure a wider work space on the desk or the like where paper-sheet processing apparatus 100 is placed, thus making it possible to increase the work efficiency of the operator.

Furthermore, according to the embodiment, fourth unit 190 turns with respect to third unit 180 around second horizontal shaft 195 extending in "front and rear direction" likewise. Thus, paper-sheet processing apparatus 100 without requiring an extra space on the rear side thereof can be provided. As a result, a wider work space can be secured on the desk or the like where paper-sheet processing apparatus 100 is placed, so that it is made possible to increase the work efficiency of the operator.

According to the present embodiment, turning first unit 160 with respect to second unit 170 to set first unit 160 in an open-state makes second transport unit 50 at least partially (the entirety of second transport unit 50 in the mode illustrated in FIG. 4) accessible. For this reason, turning first unit 160 with respect to second unit 170 makes the transport belt and/or transport roller of second transport unit 50 accessible and thus makes it possible to easily release a paper sheet jam in second transport unit 50, for example.

Moreover, according to the present embodiment, turning fourth unit 190 with respect to third unit 180 to set fourth unit 190 in an open-state makes first transport unit 30 at least partially accessible. For this reason, turning fourth unit 190 with respect to third unit 180 makes the transport belt and/or transport roller of first transport unit 30 accessible and thus makes it possible to easily release a paper sheet jam in first transport unit 30, for example.

According to the present embodiment, turning first unit 160 with respect to second unit 170 to set first unit 160 in an open-state makes intermediate transport unit 40 at least partially (the entirety of intermediate transport unit 40 in the mode illustrated in FIG. 4) accessible. For this reason, turning first unit 160 with respect to second unit 170 makes the transport belt and/or transport roller of intermediate transport unit 40 accessible and thus makes it possible to easily release a paper sheet jam in intermediate transport unit 40, for example. Note that, a similar effect can be obtained even when the mode in which turning of fourth unit 190 with respect to third unit 180 to set fourth unit 190 in an open-state makes intermediate transport unit 40 accessible is supposedly employed. In other words, even when such a mode is employed, turning of fourth unit 190 with respect to third unit 180 makes the transport belt and/or the transport roller of intermediate transport unit 40 accessible and thus makes it possible to easily release a paper sheet jam in intermediate transport unit 40, for example. Likewise, a similar effect can be obtained even when the mode is employed, in which turning of first unit 160 with respect to second unit 170 to set first unit 160 in an open-state makes intermediate transport unit 40 partially accessible while the rest of intermediate transport unit 40 is made accessible by turning fourth unit 190 with respect to third unit 180 to set fourth unit 190 in an open-state.

Moreover, in this embodiment, the length of diversion transport units 71 and 72 provided between second transport unit 50 and stacking units 80 and 90 is shorter than the paper sheet having the shortest length in the transport direction among the paper sheets recognizable by recognition unit 60. For this reason, supposedly, even when a paper sheet jam occurs at diversion transport unit 71 or 72, the operator can access the jammed paper sheet by putting his or her hand from stacking unit 80 or 90 having an opening on the front side (see FIG. 1) or by setting first unit 160 to an open-state with respect to second unit 170. Thus, the operator can easily remove the jammed paper sheet from diversion transport unit 71 or 72.

In the present embodiment, the maximum value of the length of an inaccessible part of first transport unit 30, second transport unit 50, and intermediate transport unit 40 when first unit 160 is turned with respect to second unit 170 to set it in an open-state while fourth unit 190 is turned with respect to third unit 180 to set it in an open-state is shorter than a paper sheet having the shortest length in the transport direction among the paper sheets recognizable by recognition unit 60. Thus, even in a case where a paper sheet has jammed at any of first transport unit 30, second transport unit 50, and intermediate transport unit 40, the operator can access the jammed paper sheet by turning first unit 160 with respect to second unit 170 to set it in an open-state (see FIG. 4) or turning fourth unit 190 with respect to third unit 180 to set it in an open-state (see FIG. 3). Thus, the operator can easily remove the jammed paper sheet from first transport unit 30, second transport unit 50, and/or intermediate transport unit 40.

In this embodiment, first horizontal shaft 165 used for turning first unit 160 with respect to second unit 170 and second horizontal shaft 195 used for turning fourth unit 190 with respect to third unit 180 are disposed in proximity to each other. More specifically, first horizontal shaft 165 is positioned in an upper left end region and second horizontal shaft 195 is positioned in a more inward region than first horizontal shaft 165 (lower right region in FIG. 2) as viewed from the front side.

For this reason, it is possible to match the direction in which first unit 160 turns with respect to second unit 170 and the direction in which fourth unit 190 turns with respect to third unit 180, and first unit 160 is set to an open-state with respect to second unit 170 (see FIG. 4) and fourth unit 190 can be set to an open-state with respect to third unit 180 (see FIG. 3) using a similar operation. Thus, the operability can be improved.

In a case where first horizontal shaft 165 used for turning first unit 160 with respect to second unit 170 and second horizontal shaft 195 used for turning third unit 190 with respect to third unit 180 are the same horizontal shaft, not only the operability can be improved as described above, but also the number of component members required for horizontal shafts can be one, so that the production cost can be reduced and/or the production easiness can be enhanced.

In this embodiment, as illustrated in FIG. 4, even when first unit 160 is turned with respect to second unit 170 to set first unit 160 in an open-state, first unit 160 is partially positioned outward of casing 10, i.e., partially positioned leftward of casing 10 in FIG. 4. Furthermore, in this embodiment, as illustrated in FIG. 3, even when fourth unit 190 is turned with respect to third unit 180 to set fourth unit 190 in an open-state, fourth unit 190 is not positioned outward of casing 10, i.e., not positioned leftward of casing 10 in FIG. 3. For this reason, according to this embodiment, providing a slight space on the left side of paper-sheet processing apparatus 100 as viewed from the front side is sufficient, and no space needs to be provided on the right side of paper-sheet processing apparatus 100 as viewed from the front side, so that no extra space is required on either side of paper-sheet processing apparatus 100.

Thus, the paper-sheet processing apparatus 100 according to the present embodiment can be disposed at a position where the left surface of casing 10 is placed very close to the wall or the like as viewed from the front side while the right surface of casing 10 is placed in contact with or very close to the wall or the like as viewed from the front side.

According to the present embodiment, when first unit 160 is turned with respect to second unit 170 to set first unit 160 in an open-state as illustrated in FIG. 4, second transport unit 50 and intermediate transport unit 40 can be checked from the front side. Moreover, when fourth unit 190 is turned with respect to third unit 180 to set fourth unit 190 in an open-state as illustrated in FIG. 3, first transport unit 30 can be checked from the front side. Thus, the operator can check all first transport unit 30, intermediate transport unit 40, and second transport unit 50 while remaining seated, so that the work efficiency in processing of a jammed paper sheet can be improved.

Lastly, the disclosures of the description and drawings of the above embodiment are only examples for describing the invention recited in claims and do not impose any limitations on the invention recited in the claims.

REFERENCE SIGNS LIST

10 Casing
20 Take-in unit
30 First transport unit
40 Intermediate transport unit
50 Second transport unit (horizontal transport unit)
51 Tilt portion
60 Recognition unit
71, 72 Diversion transport unit
76, 77 Diverter
80 Stacking unit
81 Stacking wheel
90 Stacking unit
91 Stacking wheel
110 Reject unit
160 First unit
165 First horizontal shaft
170 Second unit
180 Third unit
190 Fourth unit
195 Second horizontal shaft

The invention claimed is:

1. A paper-sheet processing apparatus comprising:
a casing;
a take-in unit that takes in paper sheets into the casing;
a recognition unit that recognizes each of the paper sheets taken in by the take-in unit;
a first transport unit that transports the paper sheets recognized by the recognition unit, in a first direction along a substantially horizontal direction;
a second transport unit that transports the paper sheets transported by the first transport unit, in a second direction reverse to the first direction along the substantially horizontal direction;
an intermediate transfer unit that connects between the first transport unit and the second transport unit;
a plurality of stacking units that stack the paper sheets transported by the second transport unit;
a plurality of stacking wheels provided correspondingly to the plurality of stacking units and used for stacking the paper sheets transported by the second transport unit in the stacking units; and
a display unit that is arranged on a casing surface of a direction side perpendicular to the second direction, wherein:
the plurality of stacking units include a first stacking unit positioned on an upstream side of the second direction, and a second stacking unit positioned on a further downstream side of the second direction than the first stacking unit,
the plurality of stacking wheels include a first stacking wheel that corresponds to the first stacking unit and rotates in a direction reverse to the second direction, and a second stacking wheel that corresponds to the second stacking unit and rotates in the second direction,
the first stacking unit and the second stacking unit include a first opening and a second opening respectively, and
an inside of the first stacking unit and an inside of the second stacking unit are respectively exposed via the first opening and the second opening as viewed from a display surface side of the display unit.

2. The paper-sheet processing apparatus according to claim 1, further comprising diverters provided correspondingly to each of the stacking units and each diverts the paper sheets transported by the second transport unit.

3. The paper-sheet processing apparatus according to claim 1, further comprising a reject unit provided at an end of the second transport unit that stacks the paper sheets not stacked in the plurality of stacking units, wherein the second stacking unit is positioned below the reject unit.

4. The paper-sheet processing apparatus according to claim 3, wherein the second transport unit includes a tilt portion tilted upward toward the reject unit.

5. The paper-sheet processing apparatus according to claim 3, wherein the take-in unit is positioned above the reject unit.

6. The paper-sheet processing apparatus according to claim 1, wherein at least one of the first and the second stacking units stacks the paper sheets while tilted with respect to the substantially horizontal direction.

7. The paper-sheet processing apparatus according to claim 6, wherein:
the first stacking unit stacks the paper sheets while tilted at an angle of at least 45 degrees with respect to one side of the substantially horizontal direction, and
the second stacking unit stacks the paper sheets while tilted at an angle of at least 45 degrees with respect to another side of the substantially horizontal direction reverse to the one side of the substantially horizontal direction.

8. The paper-sheet processing apparatus according to claim 1, wherein:
the first stacking wheel releases, in a direction reverse to the second direction, the paper sheets to the inside of the first stacking unit, and
the second stacking wheel releases, in the second direction, the paper sheets to the inside of the second stacking unit.

9. The paper-sheet processing apparatus according to claim 1, wherein:
the first stacking unit is covered with the casing at the upstream side of the second direction, and
the second stacking unit is covered with the casing at the downstream side of the second direction.

10. The paper-sheet processing apparatus according to claim 1, further comprising a plurality of push-out units provided correspondingly to the plurality of stacking units, wherein:
the plurality of push-out units push out the paper sheets stacked in the plurality of stacking units to the display surface side of the display unit.

11. A paper-sheet processing apparatus comprising:
a casing;
a take-in unit that takes in paper sheets into the casing;

a recognition unit that recognizes each of the paper sheets taken in by the take-in unit;

a transport unit that transports the paper sheets recognized by the recognition unit;

a plurality of stacking units that stack the paper sheets transported by the transport unit;

a plurality of stacking wheels provided correspondingly to the plurality of stacking units and used for stacking the paper sheets transported by the transport unit in the stacking units; and a display unit that is arranged on a surface of the casing, wherein:

the plurality of stacking units include a first stacking unit positioned on an upstream side of a transport direction of the paper sheets, and a second stacking unit positioned on a further downstream side of the transport direction than the first stacking unit, the plurality of stacking wheels include a first stacking wheel that corresponds to the first stacking unit and rotates in a direction reverse to a direction toward the second stacking unit from the first stacking unit, and a second stacking wheel that corresponds to the second stacking unit and rotates in the direction toward the second stacking unit from the first stacking unit, the first stacking unit and the second stacking unit include a first opening and a second opening respectively, and the display unit is arranged between the first stacking unit and second stacking unit with respect to the transport direction.

* * * * *